US007195413B2

(12) United States Patent
Kremizis

(10) Patent No.: US 7,195,413 B2
(45) Date of Patent: Mar. 27, 2007

(54) RETRACTABLE APPLICATOR SYSTEM

(75) Inventor: Evangelia Kremizis, Beechhurst, NY (US)

(73) Assignee: Evangelia Parlionas, Beechhurst, NY (US)

( * ) Notice: Subject to any disclaimer, the term of this patent is extended or adjusted under 35 U.S.C. 154(b) by 0 days.

(21) Appl. No.: 11/112,687

(22) Filed: Apr. 22, 2005

(65) Prior Publication Data

US 2006/0239755 A1 Oct. 26, 2006

(51) Int. Cl.

| | |
|---|---|
| ***B43K 23/02*** | (2006.01) |
| ***B65H 75/40*** | (2006.01) |
| ***A01K 97/04*** | (2006.01) |
| ***A45F 5/00*** | (2006.01) |

(52) U.S. Cl. ..... 401/131; 224/162; 224/197; 224/251; 224/677

(58) Field of Classification Search ..... 401/48, 401/52, 131, 195; 224/162, 197, 251, 254, 224/269, 677

See application file for complete search history.

(56) References Cited

U.S. PATENT DOCUMENTS

| | | | | |
|---|---|---|---|---|
| 264,593 | A * | 9/1882 | Wright | 242/385.1 |
| 1,567,783 | A | 12/1925 | Best | |
| 4,748,937 | A | 6/1988 | Musetti | |
| 4,898,532 | A | 2/1990 | Bercik | |
| 5,026,274 | A | 6/1991 | Jacob | |
| D397,286 | S | 8/1998 | Dreyfus et al. | |
| 6,241,750 | B1 | 6/2001 | Moultrie | |
| 6,283,658 | B1 | 9/2001 | Estevez et al. | |
| 6,364,237 | B1 | 4/2002 | Kagel | |
| 6,382,481 | B1 | 5/2002 | Mciimoil | |
| 6,499,899 | B2 * | 12/2002 | Sawyer | 401/131 |
| 6,641,390 | B2 * | 11/2003 | Genuise | 431/253 |
| 6,854,681 | B2 * | 2/2005 | Kish | 242/380 |
| 2002/0000455 | A1 | 1/2002 | Condliff et al. | |
| 2004/0089759 | A1 | 5/2004 | Genuise | |

* cited by examiner

*Primary Examiner*—David J. Walczak
(74) *Attorney, Agent, or Firm*—Mark J. Rosenberg; Aasheesh Shravah; Sills, Cummis, Epstein & Gross

(57) ABSTRACT

A retractable applicator system for retractably securing a lip care product to a garment of a user. The retractable applicator system includes an applicator for containing and applying a lip care substance to the lips of the user. A retractor assembly is coupled to the applicator for removably mounting the applicator to a garment of the user in a manner that permits selective movement of the applicator away from the body of the user.

19 Claims, 4 Drawing Sheets

RETRACTABLE APPLICATOR SYSTEM

BACKGROUND OF THE INVENTION

1. Field of the Invention

The present invention relates to retractable article holders and more particularly pertains to a new retractable applicator system for retractably securing a lip care product to a garment of a user.

2. Description of the Prior Art

The use of applicators for applying lip care substances to the lips of a user are often easily misplaced and lost thus reducing their value to the user. The combination of the retractor assembly with an applicator allows the user to readily locate and use the applicator and have the applicator returned to a known location when the applicator is released. The prior art is crowded with retractable article holders but lacks a combination retractor assembly and applicator.

SUMMARY OF THE INVENTION

The present invention provides a new retractable applicator system wherein the same can be utilized for retractably securing a lip care product to a garment of a user.

To attain this, the present invention generally comprises an applicator for containing and applying a lip care substance to the lips of the user. A retractor assembly is coupled to the applicator for removably mounting the applicator to a garment of the user in a manner that permits selective movement of the applicator away from the body of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is that is allows the user to position the applicator of the lip care substance in a convenient location so that the applicator and be easily found when needed while inhibiting the inadvertent loss of the applicator.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
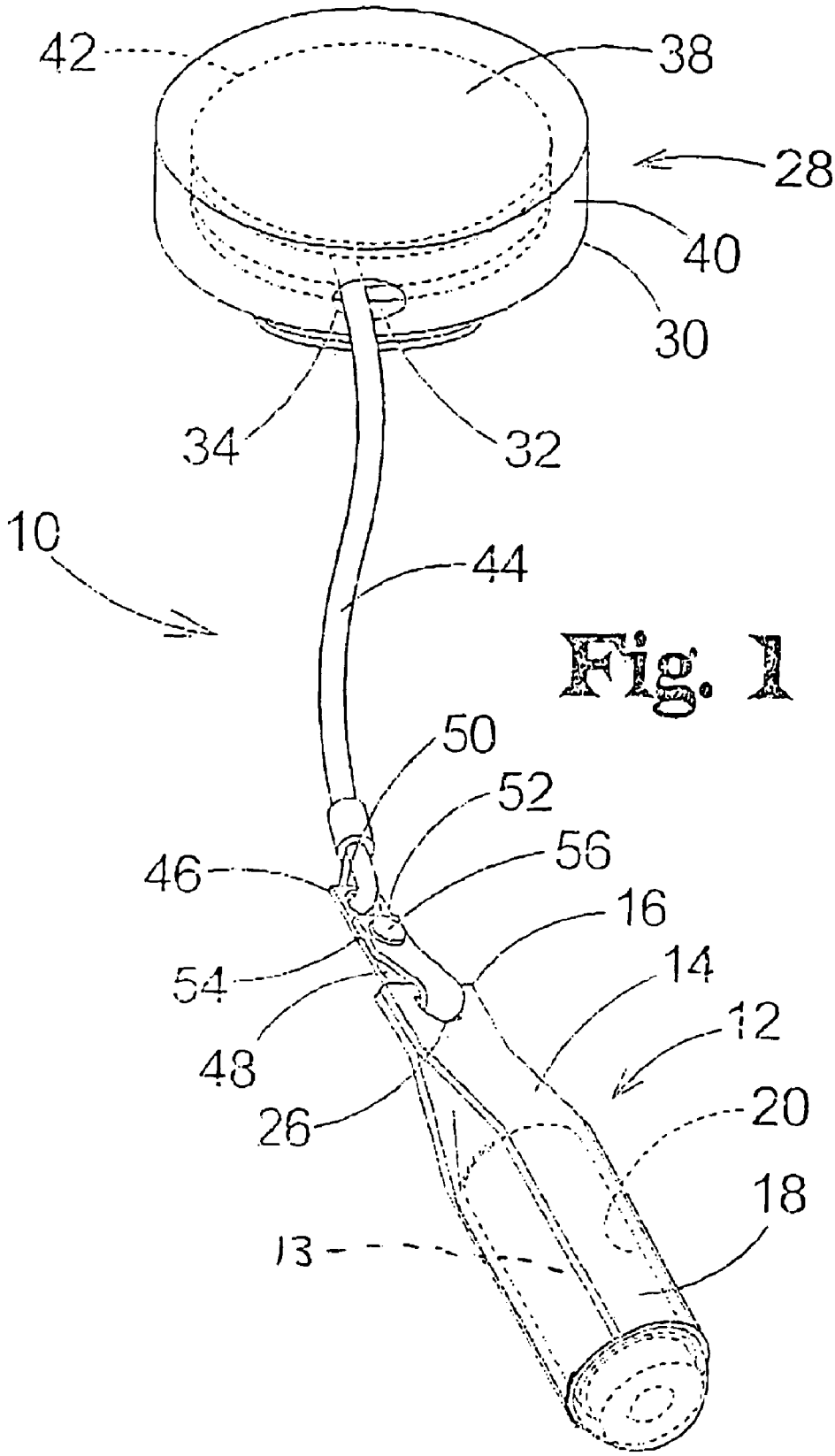
FIG. 1 is a perspective view of a first embodiment of the new retractable applicator system according to the present invention showing the lanyard extended from the housing.

With reference now to the drawings, and in particular to FIGS. 1 through 4 thereof, a new retractable applicator system embodying the principles and concepts of the present invention and generally designated by the reference numeral 10 will be described.

As best illustrated in FIGS. 1 through 4, the retractable applicator system 10 generally comprises an applicator 12 for containing and applying a lip care substance to the lips of a user and a retractor assembly 28 for removably mounting the applicator 12 to a garment of the user.

Figure 2:
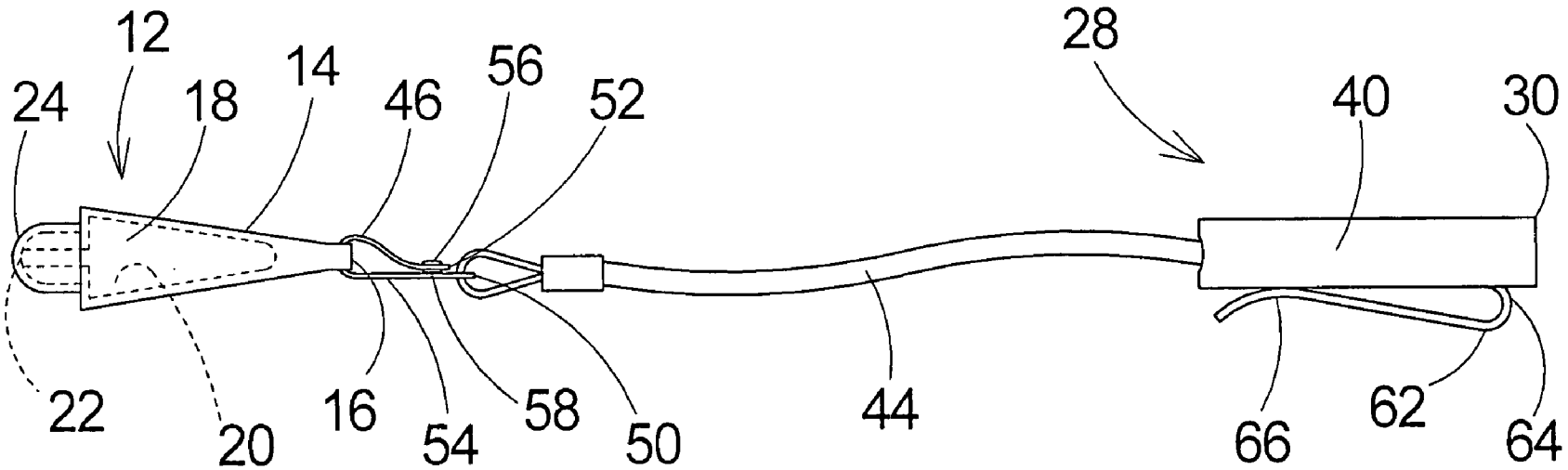
FIG. 2 is a side view of a second embodiment of the present invention.
Figure 3:
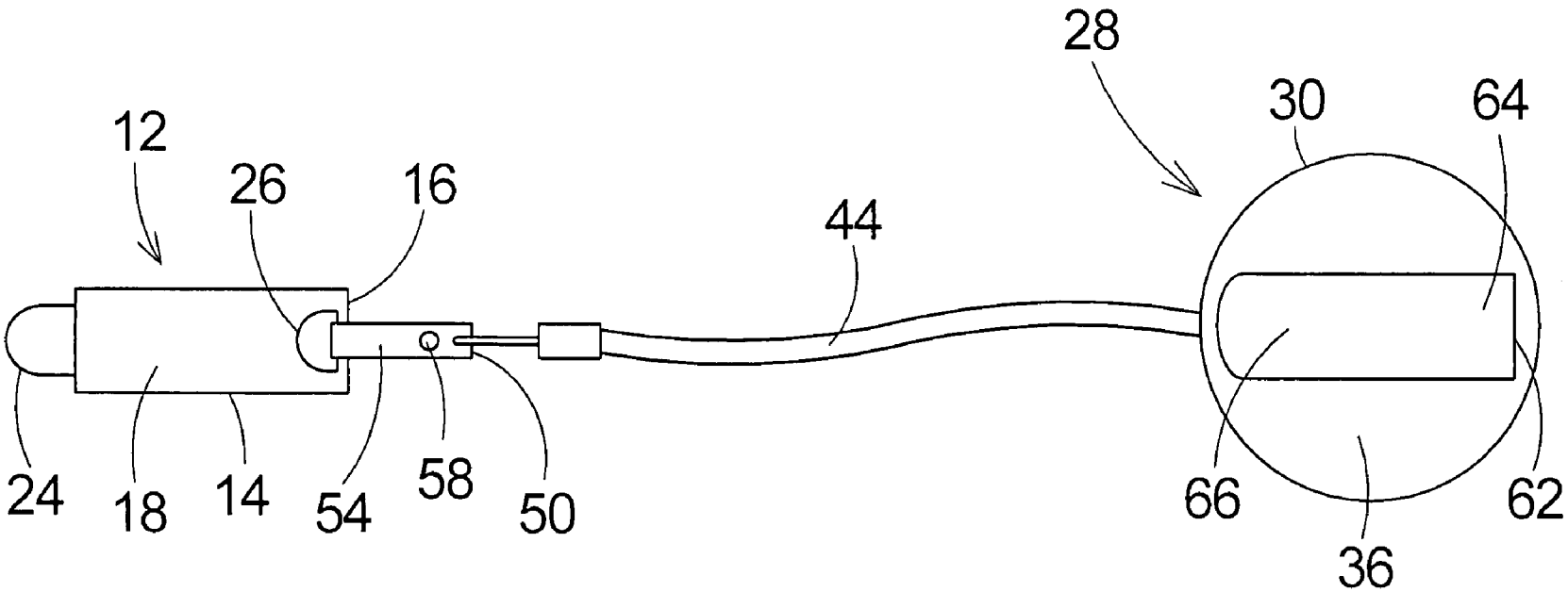
FIG. 3 is a rear view of the second embodiment of the present invention.
Figure 4:
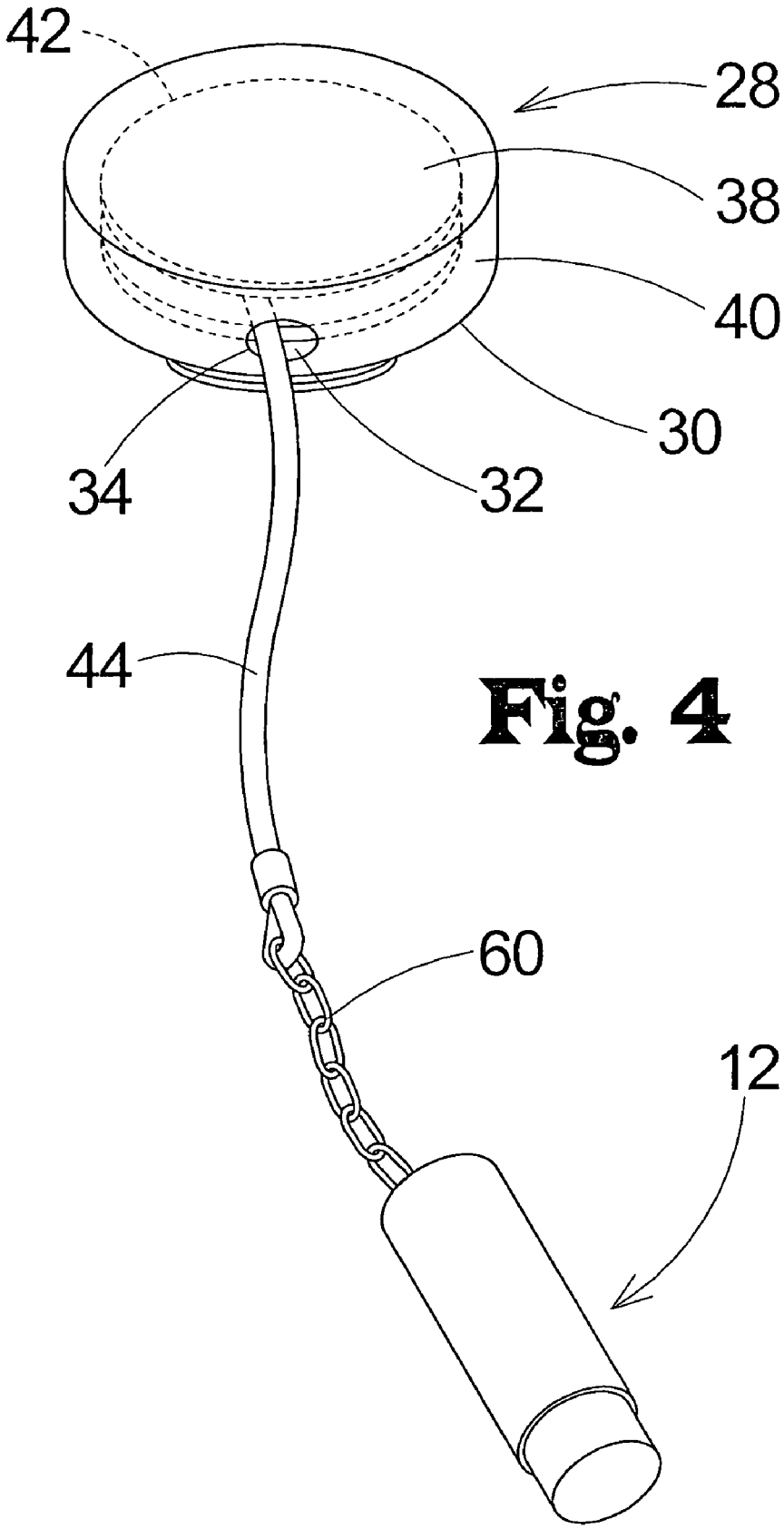
FIG. 4 is a perspective view of a third embodiment of the present invention which is similar to the first embodiment of the invention.

The applicator 12 may include a base portion 14 for containing the lip care substance. The base portion 14 may comprise a base wall 16 and a perimeter wall 18. In the embodiment depicted in FIG. 1, the portions of the perimeter wall 18 converge together to form the base wall 16. In the embodiment of FIGS. 2 and 3, the base portion 14 forms a container for the lip care substance, and the perimeter wall 18 also converges to form the base wall 16. In the embodiment of FIG. 4, the perimeter wall 18 extends substantially orthogonally from the base wall 16. The base wall 16 and the perimeter wall 18 define an interior space 20 for receiving the lip care substance. In the embodiment of FIG. 1, the interior space removably receives a portion of a lip care substance container 13 (similar to a lipstick applicator) that is inserted into the base portion when full and removed from the base portion when empty. In the embodiment of FIGS. 2 and 3, the base portion forms the lip care substance container itself, and the base portion 14 has a dispensing opening 22 that permits dispensing of the lip care substance from the interior of the base member. In the embodiment of FIGS. 2 and 3, the base portion 14 is simply removed from the retractor assembly 28 when all of the lip care substance has been removed from the container, and another lip care substance container is mounted on the retracting assembly. In the embodiment of FIG. 4, the base portion 14 also forms the container for the lip care substance.

The applicator 12 may further include a cap portion 24 that is removably coupled to the perimeter wall 18 of the base portion 14 opposite of the base wall 16. In the embodiments of FIGS. 2 and 3, the cap portion 24 removably covers the dispensing opening 22 of the base portion 14 to prevent inadvertent dispensing of the lip care substance from the interior, as well as to inhibit drying out of the lip care substance, when the cap portion 24 is coupled to the perimeter wall 18 of the base portion 14.

The applicator 12 may include a bore 26 that extends through the base portion 14. The bore 26 may extend substantially perpendicular to a longitudinal axis of the base portion 14. The bore 26 may be positioned on an end of the base portion 14 opposite of the end having the dispensing opening 22. In the embodiment of FIG. 2, the bore 26 is formed in the lip care substance container itself, and the perimeter walls 18 of the base portion 14 are configured to inhibit communication between the bore 26 and the interior space 20, such as by joining of opposite portions of the perimeter wall at the location of the bore 26.

The retractor assembly 28 of the invention permits selective movement of the applicator 12 away from the garment on the body of the user.

The retractor assembly 28 may include a housing 30 defining a receiving space 32 with an aperture 34 extending through the housing 30. The aperture 34 is in communication with the receiving space 32 of the housing 30 and the exterior of the housing. Illustratively, the housing 30 may be substantially disk shaped to inhibit the housing 30 from snagging on the garment of the user, although other shapes may also be employed. The housing 30 may comprise a back wall 36, a front wall 38 and a peripheral wall 40 extending between the front wall 38 and the back wall 36. As shown in FIGS. 1 and 4, the peripheral wall 40 may be annular in shape. The aperture 34 may be located in, and extend through, the peripheral wall 40.

The retractor assembly 28 further comprises a spool 42 mounted on the housing 30 with the spool 42 being positioned in the receiving space 32 of the housing 30. The spool 42 is positioned between the front wall 38 and the back wall 36 of the housing 30.

The retractor assembly 28 may further comprise a lanyard member 44 coupled to the spool 42. A portion of the lanyard member 44 is extendable from the receiving space 32 through the aperture 34 of the housing 30 when the lanyard member 44 is pulled by the user. The spool 42 retracts a portion of the lanyard member 44 into the receiving space 32 when the lanyard member 44 is released by the user, thus maintaining a degree of retracting tension on the lanyard at all times. The lanyard may comprise a substantially flexible material to facilitate winding of the lanyard member 44 onto the spool 42 and to permit the user to direct the applicator 12 to the desired location (such as adjacent the lips) for the application of the lip care substance.

The retractor assembly 28 may further comprise a securing member 46 coupled to the lanyard member 44 opposite the housing 30. The securing member 46 is removably coupled to the base portion 14 of the applicator 12 to secure the applicator 12 to the retractor assembly 28. The securing member 46 may comprise a strap portion 48 extending through the bore 26 of the base portion 14 of the applicator 12 to secure the applicator 12 to the lanyard member 44. The strap portion 48 may comprise a strip of flexible material permitting the planar portion 48 to bend through the bore 26 of the applicator 12. The strap portion 48 has a proximal end 50 and a distal end 52. The proximal end 50 is coupled to the lanyard member 44. The distal end 52 is extended through the bore 26 of the applicator 12 and secured to a medial section 54 of the strap portion 48 to secure the applicator 12 to the lanyard member 44. The securing member 46 may comprise a first fastener portion 56 and a second fastener portion 58. The first fastener portion 56 is coupled to the distal end 52 of the strap portion 48. The second fastener portion 58 is coupled to the medial section 54 of the strap portion 48. The first fastener portion 56 is complimentary to the second fastener portion 58 to allow the distal end 52 of the strap portion 48 to be secured to the medial section 54 of the strap portion 48.

In the embodiment of FIG. 4, the securing member 46 may comprise a chain 60 being secured to the lanyard member 44. The chain 60 extends between the base wall 16 of the applicator 12 and the lanyard member 44 to secure the applicator 12 to the lanyard member 44. The chain 60 may be coupled to the base wall 16 with a screw or adhesive (or other suitable fastening means) to ensure that the chain 60 is secured to the applicator 12.

The retractor assembly 28 may further comprise a clip member 62 coupled to the back wall 36 of the housing 30 of the reel member. The clip member 62 may be self-biasing for compressing or pinching a portion of a garment of the user between the clip member 62 and the back wall 36 of the housing 30 to secure the retractor assembly 28 to the user. The clip member 62 may comprise a first end portion 64 coupled to the back wall 36 proximate the peripheral wall 40 of the housing 30 and extending back over the back wall 36. The clip member 62 may comprise a second end portion 66 that extends from the first end portion 64 opposite the peripheral wall 40. The second end portion 66 may extend in an arcuate manner towards the back wall 36 from the first end portion 64 and then extend in an arcuate manner away from the back wall 36 opposite the first end portion 64 to permit the garment to be removably inserted between the second end portion 66 and the back wall 36 to permit the second end portion 66 of the clip member 62 to compress the garment against the back wall 36.

In use, the user inserts a portion of a garment that the user is wearing between the second end portion 66 of the clip member 62 and the back wall 36 of the housing 30 to secure the retractor assembly 28 to the garment. The user is then able to grip the applicator 12 and draw the lanyard out of the housing 30 to position the applicator 12 in a desired location. The cap portion 24 can then be removed to allow the lip care substance to be dispensed from the dispensing opening 22 to the lips. When the user has finished dispensing the lip care substance the cap portion 24 is returned to the base portion 14 of the applicator 12. The user can then release the applicator 12 and the spool 42 will retract a portion the lanyard back into the housing 30 and thereby draw the applicator 12 back to the housing 30 which allows the user to have the lip care product in a convenient location.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for retractably securing a lip care product to a garment of a user, the system comprising:

an applicator forming an interior space therein containing a lip care substance; said applicator comprising a base portion on a first end and a dispensing portion on a second end wherein said interior space cannot be removed from said base portion; and a retractor assembly for removably mounting said applicator to a garment of the user in a manner that permits selective movement of said applicator away from the body of the user;

wherein said retractor assembly is connected directly to the base portion of the applicator such that when said applicator is freely hanging below said retractor assembly, said base portion is positioned closer to said retractor assembly than said dispensing portion and said dispensing portion is positioned below said base portion.

2. The system as set forth in claim 1, wherein said base portion comprises a base wall and a perimeter wall, said perimeter wall extending substantially orthogonally from said base wall, said base wall and said perimeter wall defining said interior space.

3. The system as set forth in claim 1, wherein said dispensing portion has a dispensing opening for dispensing the lip care substance from said interior of said base portion.

4. The system as set forth in claim 3, wherein said applicator comprises a cap portion being removably coupled to said dispensing portion, said cap portion removably covering said dispensing opening of said dispensing portion for inhibiting, contact between the lip care substance and the garment of the user when said cap portion is covering said dispensing opening.

5. The system as set forth in claim 1, wherein the base portion defines a bore extending through said base portion for facilitating coupling of said retractor assembly to said applicator, said bore extending substantially perpendicular to a longitudinal axis of said base portion, said base portion inhibiting communication between said bore and said interior space.

6. The system as set forth in claim 1, wherein said retractor assembly comprises a housing defining a receiving space and an aperture extending through said housing, said aperture being in communication with said receiving space of said housing.

7. The system as set forth in claim 6, wherein said housing is substantially disk shaped to inhibit said housing being inadvertently snagged on the garment of the user.

8. The system as set forth in claim 6, wherein said housing comprises a back wall, a front wall and a peripheral wall, said peripheral wall extending between said front wall and said back wall, said aperture extending through said peripheral wall.

9. The system as set forth in claim 6, wherein a lanyard member is extendable from said receiving space through said aperture of said housing when said lanyard member is pulled by the user.

10. The system as set forth in claim 9, wherein said retractor assembly comprises a spool mounted to said housing such that said spool is positioned in said receiving space of said housing, said spool retracting a portion of said lanyard member into said receiving space when said lanyard member is released by the user.

11. The system as set forth in claim 9, wherein said lanyard comprises a substantially flexible material to allow the user to direct said applicator to a desired location.

12. The system as forth in claim 9, wherein said retractor assembly comprises a securing member being coupled to said lanyard member opposite said housing, said, securing member being removably coupled to said applicator to secure said applicator to said retractor assembly.

13. The system as set forth in claim 12, wherein said securing member comprises a planar portion extending through a bore extending through said applicator to secure said applicator to said lanyard member.

14. The system as set forth in claim 13, wherein a planar portion comprises a strip of flexible material permitting said planar portion to bend through said bore of said applicator.

15. The system as set forth in claim 13, wherein said planar portion has a proximal end and a distal end, said proximal end being coupled to said lanyard member, said distal end being extended through said bore of said applicator and secured to a medial section of said planar portion to secure said applicator to said lanyard member.

16. The system as set forth in claim 15, wherein said securing member comprises a first fastener portion and a second fastener portion, said first fastener portion being coupled to said distal end of said planar portion, said second fastener portion being coupled to said medial section of said planar portion, said first fastener portion being complimentary to said second fastener portion to allow said distal end of said planar portion to be secured to said medial section of said planar portion.

17. The system as set forth in claim 12, wherein said securing member comprises a chain being secured to said lanyard member, said chain being coupled to said base wall of said applicator to secure said applicator to said lanyard member.

18. The system as set forth in claim 6, wherein said retractor assembly comprises a clip member being coupled to said housing, said clip member being self-biasing for compressing a portion, of a garment of the user between said clip member and said housing to secure said retractor assembly to the user.

19. A system for retractably securing a lip care product to a garment of a user, the system comprising:

an applicator forming an interior space therein containing a lip care, substance, said applicator comprising:

a base portion on a first end and a dispensing portion on a second end wherein said interior space cannot be removed from said base portion, said base portion comprising a base wall and a perimeter wall, said perimeter wall extending from said base wall, said base, wall and said perimeter wall defining said interior space for receiving the lip care substance;

said dispensing portion having a dispensing opening for dispensing the lip care substance from said interior of said base member; and a cap portion being removably coupled to said perimeter wall opposite said base wall, said cap portion removably covering said dispensing opening of said dispensing portion;

said base portion defining a bore extending through said base portion such that said bore extends substantially perpendicular to a longitudinal axis of said base portion; said bore being positioned opposite said dispensing opening, said base portion inhibiting communication between said bore and said interior space; and a retractor assembly for removably mounting said applicator to a garment of the user in a manner that permits selective movement of said applicator away from the body of the user; wherein said retractor assembly is connected directly to the base portion of the applicator, such that when said applicator is freely hanging below said retractor assembly, said base portion is positioned closer to said retractor assembly than said dispensing portion and said dispensing portion is positioned below said base portion, said retractor assembly comprising:

a housing defining a receiving space and an aperture extending through said housing, said aperture being in communication with said receiving space of said housing, said housing being substantially disk shaped, said housing comprising a back wall, a front wall and a peripheral wall, said peripheral wall extending between said front wall and said back wall, said peripheral wall being substantially annular, said aperture extending through said peripheral wall;

a spool being mounted to said housing such that said spool is positioned in said receiving space of said housing, said spool being positioned between said front wall and said back wall of said housing;

a lanyard member being coupled to said spool, said lanyard member being extendable from said receiving space through said aperture of said housing when said lanyard member is pulled by the user, said spool retracting a portion of said lanyard member into said receiving space when said lanyard member is released by the user, said lanyard comprising a substantially flexible material to facilitate winding of said lanyard member onto said spool;

a securing member being coupled to said lanyard member opposite said housing, said securing member being directly and removably coupled to said base wall of said applicator to secure said applicator to said retractor assembly, said securing member comprising a planar position extending through a bore of said base portion of said applicator to secure said applicator to said lanyard member, said planar portion comprises a strip of flexible material permitting said planar portion to bend through said bore of said applicator, said planar portion having a proximal end and a distal end, said proximal end being coupled to said lanyard member, said distal end being extended through said bore of said applicator and secured to a medial section of said planar portion to secure said applicator to said lanyard member, said securing member comprises a first fastener portion and a second fastener portion, said first fastener portion being coupled to said distal end of said planar portion, said second fastener portion being coupled to said medial section of said planar portion, said first fastener portion being complimentary to said second fastener portion to allow said distal end of said planar portion to be secured to said medial section of said planar portion; and a clip member being coupled to said back wall of said housing of said reel member, said clip member being self-biasing for compressing a portion of a garment of the user between said clip member and said back wall of said housing to secure said retractor assembly to the user, said clip member comprising a first end portion being coupled to said back wall proximate said peripheral wall of said housing and extending back over said back wall, said clip member comprising a second end portion extending from said first end portion opposite said peripheral wall, said second end portion arcuately extending towards said back wall from said first end portion and then arcuately extend away from said back wall opposite said first end portion to permit the garment to be removably inserted between said second end portion and said back wall to permit said second end portion of said clip member to compress the garment against said back wall.

* * * * *

UNITED STATES PATENT AND TRADEMARK OFFICE

CERTIFICATE OF CORRECTION

PATENT NO. : 7,195,413 B2
APPLICATION NO. : 11/112687
DATED : March 27, 2007
INVENTOR(S) : Evangelia Parlionas It is certified that error appears in the above-identified patent and that said Letters Patent is hereby corrected as shown below:

Title Page, under Item (12) Delete "Kremizis" and insert -- Parlionas --

Title Page, under Item (75) inventors: Delete "Kremizis" and insert -- Parlionas --.

Signed and Sealed this

Fifteenth Day of May, 2007

JON W. DUDAS
*Director of the United States Patent and Trademark Office*

UNITED STATES PATENT AND TRADEMARK OFFICE

CERTIFICATE OF CORRECTION

PATENT NO. : 7,195,413 B2
APPLICATION NO. : 11/112687
DATED : April 22, 2005
INVENTOR(S) : Evangelia Parlionas It is certified that error appears in the above-identified patent and that said Letters Patent is hereby corrected as shown below:

Title Pg, Item (74)
Delete Mark J. Rosenberg from Attorney of Record

Signed and Sealed this

Fourth Day of March, 2008

JON W. DUDAS
*Director of the United States Patent and Trademark Office*

UNITED STATES PATENT AND TRADEMARK OFFICE

CERTIFICATE OF CORRECTION

PATENT NO. : 7,195,413 B2
APPLICATION NO. : 11/112687
DATED : March 27, 2007
INVENTOR(S) : Evangelia Parlionas It is certified that error appears in the above-identified patent and that said Letters Patent is hereby corrected as shown below:

Title Pg, Item (74)
Delete Mark J. Rosenberg from Attorney of Record

This certificate supersedes the Certificate of Correction issued March 4, 2008.

Signed and Sealed this

First Day of April, 2008

JON W. DUDAS
*Director of the United States Patent and Trademark Office*